US007214040B2

(12) United States Patent
Froeslev et al.

(10) Patent No.: US 7,214,040 B2
(45) Date of Patent: May 8, 2007

(54) CYLINDER HEAD ARRANGEMENT FOR A PISTON COMPRESSOR

(75) Inventors: Peter Froeslev, Sydals (DK); Frank Holm Iversen, Padborg (DK)

(73) Assignee: Danfoss Compressors GmbH, Flensburg (DE)

( * ) Notice: Subject to any disclaimer, the term of this patent is extended or adjusted under 35 U.S.C. 154(b) by 653 days.

(21) Appl. No.: 10/664,569

(22) Filed: Sep. 19, 2003

(65) Prior Publication Data

US 2005/0002811 A1 Jan. 6, 2005

(30) Foreign Application Priority Data

Sep. 25, 2002 (DE) ..... 102 44 566

(51) Int. Cl.
*F04B 39/10* (2006.01)

(52) U.S. Cl. ..... 417/571

(58) Field of Classification Search ..... 417/569, 417/571

See application file for complete search history.

(56) References Cited

U.S. PATENT DOCUMENTS 2,036,799 A * 4/1936 Duryee ..... 417/571
2,062,206 A * 11/1936 Browne ..... 417/571
2,160,401 A * 5/1939 Engelman ..... 417/559
2,935,248 A * 5/1960 Gerteis ..... 417/571
3,112,064 A * 11/1963 Ayling ..... 417/571
4,100,934 A * 7/1978 Butterworth et al. ..... 417/571
4,329,125 A * 5/1982 Chambers ..... 417/569
4,470,774 A * 9/1984 Chambers ..... 417/569
4,573,880 A 3/1986 Hirano et al.
6,158,974 A 12/2000 Tarutani et al.
6,692,243 B1 * 2/2004 Rousseau ..... 418/201.1

FOREIGN PATENT DOCUMENTS

JP 8-247021 * 9/1996

* cited by examiner

*Primary Examiner*—Michael Koczo, Jr.
(74) *Attorney, Agent, or Firm*—McCormick, Paulding & Huber LLP

(57) ABSTRACT

The invention relates to a cylinder head arrangement for a piston compressor, particularly for a hermetically enclosed refrigerant compressor, with a valve plate, a suction gas channel, a discharge chamber and a retainer element for a discharge valve. It is endeavoured to improve the efficiency of the piston compressor. For this purpose, it is ensured that the suction gas channel and the discharge chamber are arranged on different sides of the retainer element.

12 Claims, 4 Drawing Sheets

CYLINDER HEAD ARRANGEMENT FOR A PISTON COMPRESSOR

CROSS-REFERENCE TO RELATED APPLICATIONS

This application is entitled to the benefit of and incorporates by reference essential subject matter disclosed in German Patent Application No. 102 44 566.4 filed on Sep. 25, 2002.

FIELD OF THE INVENTION

The invention relates to a cylinder head arrangement for a piston compressor, particularly for a hermetically enclosed refrigerant compressor, with a valve plate, a suction gas channel, a discharge chamber and a retainer element for a discharge valve.

BACKGROUND OF THE INVENTION

In such a piston compressor, gas, for example the gas of a refrigerant, is sucked into a compression chamber of the compressor via the suction gas channel. When the volume of the compression chamber is reduced, the gas is compressed, and discharged via the discharge gas channel, when reaching a predetermined pressure. A discharge valve controls this discharge. The retainer element is provided to ensure a limitation of the opening of the discharge valve.

The compression of the gas in the compression chamber causes an increase of the gas temperature. On the other hand, the temperature of the suction gas should of course be as low as possible, in order that the compression chamber can be filled with the largest possible gas amount. The higher the temperature of the suction gas, the poorer the efficiency of the compressor.

In a motor compressor known from DE 32 42 858 A1, the suction gas and the discharge gas are led in parallel for a certain distance. This gives relatively large contact areas, in which the channels or chambers, which carry the suction gas or the discharge gas, respectively, are adjacent to each other. Thus, a relatively large amount of heat from the hot discharge gas can be transferred to the suction gas.

The invention is based on the task of improving the efficiency of a piston compressor.

SUMMARY OF THE INVENTION

With a cylinder head arrangement as mentioned in the introduction, this task is solved in that the suction gas channel and the discharge chamber are arranged on different sides of the retainer element.

With this embodiment, the suction gas channel and the discharge chamber or the discharge gas channel are separated by the retainer element. This gives new opportunities with regard to the guiding of the suction gas channel and the discharge chamber or the discharge gas channel, respectively, so that their contact areas become as small as possible. The smaller the contact areas between the suction gas channel and the discharge chamber or the discharge gas channel, respectively, the smaller the heat transfer from the discharge gas to the suction gas.

Preferably, the suction gas channel and one flow direction of the discharge gas to the discharge chamber are arranged to be radial to one another. In other words, one of the two channels extends radially to the movement direction of a piston of the piston compressor, whereas the other channel extends axially. Thus, an area, in which the two channels have to extend close to each other, can be kept relatively small. In fact, this "contact area" can even be limited to the valve plate, when it is still intended to charge and discharge the compression chamber of the compressor from its front side. The radial arrangement of one of the channels in the cylinder head arrangement makes the total volume of a cylinder head cover available for the adoption of the compressed gas. As this chamber can now better be utilised, it is possible to keep the cross-sectional dimensions of the valve plate and the retainer element as small as possible. This gives advantages with regard to costs. The usual division of the volume inside the cylinder head cover into a suction chamber and a discharge chamber, and the sealing problems involved in this, is no longer necessary.

Preferably, the suction gas channel extends radially and has, in the area of the deflection from the radial to the axial direction, a curved baffle. In spite of the directional change, which the suction gas has to perform in the suction gas channel, flow resistances are kept small. The risk that eddies occur is relatively small. This also reduces the suction noise to a low level. The fact that suction gas channels no longer extend axially through the retainer element causes that a relatively large-volume outlet chamber for the compressed gas can be formed on the upper side of the retainer element. Through a suitable design of the sidewalls, this chamber can provide favourable flow conditions for the gas. In principle, it is also possible to provide several discharge gas openings. This can give an additional reduction of the noise development through a reduction of the flow velocity. Also resonances, which may occur in the gas flow, can be avoided by the increase of the flow cross-section.

It is preferred that the baffle has a large curvature radius. Basically it appears that the larger the curvature radius, the lower the flow resistance.

Preferably, the suction gas channel ends in a suction opening, whose edges are rounded. The suction opening is arranged in the valve plate. The rounding of the edges causes that eddies can hardly occur.

Preferably, the suction gas channel extends between the retainer element and the valve plate. Thus, the retainer element and the valve plate can be used as limiting walls for the suction gas channel. This enables a relatively compact design of the cylinder head arrangement. The retainer element forms a thermal protection between the suction gas channel and the discharge gas chamber, in which the discharge gas channel ends. In a similar manner, the valve plate forms a protection between the suction gas channel and the compressor, so that a heat transfer to the suction gas sucked into the suction gas channel can be kept relatively small.

It is preferred that a recess in the retainer element and/or in the valve plate forms the suction gas channel. The retainer element and/or the valve plate then additionally form the sidewalls of the suction gas channel. This simplifies the design.

Preferably, the suction gas channel is divided into several sections, each section ending in a compression chamber via its own suction opening. Thus, several paths are available, through which the suction gas can reach the compression chamber. The flow velocity in a single section can thus be reduced, which again has a favourable effect on the noise behaviour of the cylinder head and thus also of the piston compressor. As the sections of the suction gas channel are no longer arranged on the same side as the discharge gas channel or the discharge chamber, more room is available.

It is preferred that the suction openings are arranged around a pressure opening, which is arranged in the valve plate. This gives a symmetrical loading of the compression chamber. When only two suction openings are provided, these two suction openings are arranged on opposite sides of the pressure opening.

Preferably, the retainer element and/or the valve plate are made of a material, which has lower heat conductivity than unalloyed steel. The traditional valve plates and retainer elements are made of unalloyed carbon steels or of sintered steels, respectively, whose heat conductivity coefficients amount to about 50 W/m/K. When using a material with lower heat conductivity, for example only 30 W/m/K, the heat transfer through the retainer element or through the valve plate is lower. The valve plate or the retainer element can then in fact be used as a thermal resistance.

It is preferred that the valve plate and/or the retainer element are made of a ceramic material, high-grade steel or fibre-reinforced plastic. However, a ceramic material is preferred. For example, sintered aluminium oxide or silicon nitride or zirconium oxide can be used. Zirconium oxide, for example, has a heat conductivity coefficient of only 2 W/m/K. Ceramic surfaces are very wear resistant, so that the surface quality does not change significantly during use. Thus, flow losses, which could occur because of an increased surface roughness, as well as leakages in the area of the valve seats, are avoided. Ceramic components can be manufactured by means of pressing, drying and sintering a granulate mixed with binders. Thus, relatively complex structures can be manufactured within relatively accurate tolerances without expensive refinishing. This increases the freedom with regard to design and at the same time reduces the manufacturing costs.

Preferably, the valve plate and/or the retainer element have a surface quality and rigidity, which make a sealing between the valve plate and the retainer element dispensable. When, for example, the retainer element has a sufficient rigidity and thus a sufficient natural stability, the control of the opening movement of the discharge valve and thus the discharge of the discharge gas is improved, which again has a positive effect on the efficiency of the compressor. Thickness tolerances of a sealing no longer play a role. During mass production, also the production variances for the compressor efficiencies are substantially reduced.

Preferably, the valve plate and the retainer element are made as circular discs. In relation to known, square components, the outer contour is simpler and less expensive in production and finishing. Material is saved, and a grinding surface can be utilised better, when the parts are turning.

Preferably, the suction valve and/or the discharge valve are made as leaf valves with a valve leaf, which is part of a suction or discharge valve plate. The suction valve plate can simply be arranged between the cylinder and the valve plate, and the discharge valve plate can simply be arranged between the valve plate and the retainer element, and additional fixing means are not required. When the suction valve plate and the discharge valve plate have the same outer dimensions as the valve plate and the retainer element, that is, are also circular, those four parts can simply be aligned with each other in that they are placed on one another and the outer contours are brought to match. This simplifies the manufacturing. For example, this "valve block" can simply be inserted in a corresponding cylinder-shaped recess in the suction muffler.

BRIEF DESCRIPTION OF THE DRAWINGS

In the following, the invention is described in detail on the basis of a preferred embodiment in connection with the drawings, showing.

DETAILED DESCRIPTION OF THE PREFERRED EMBODIMENTS

Figure 1:
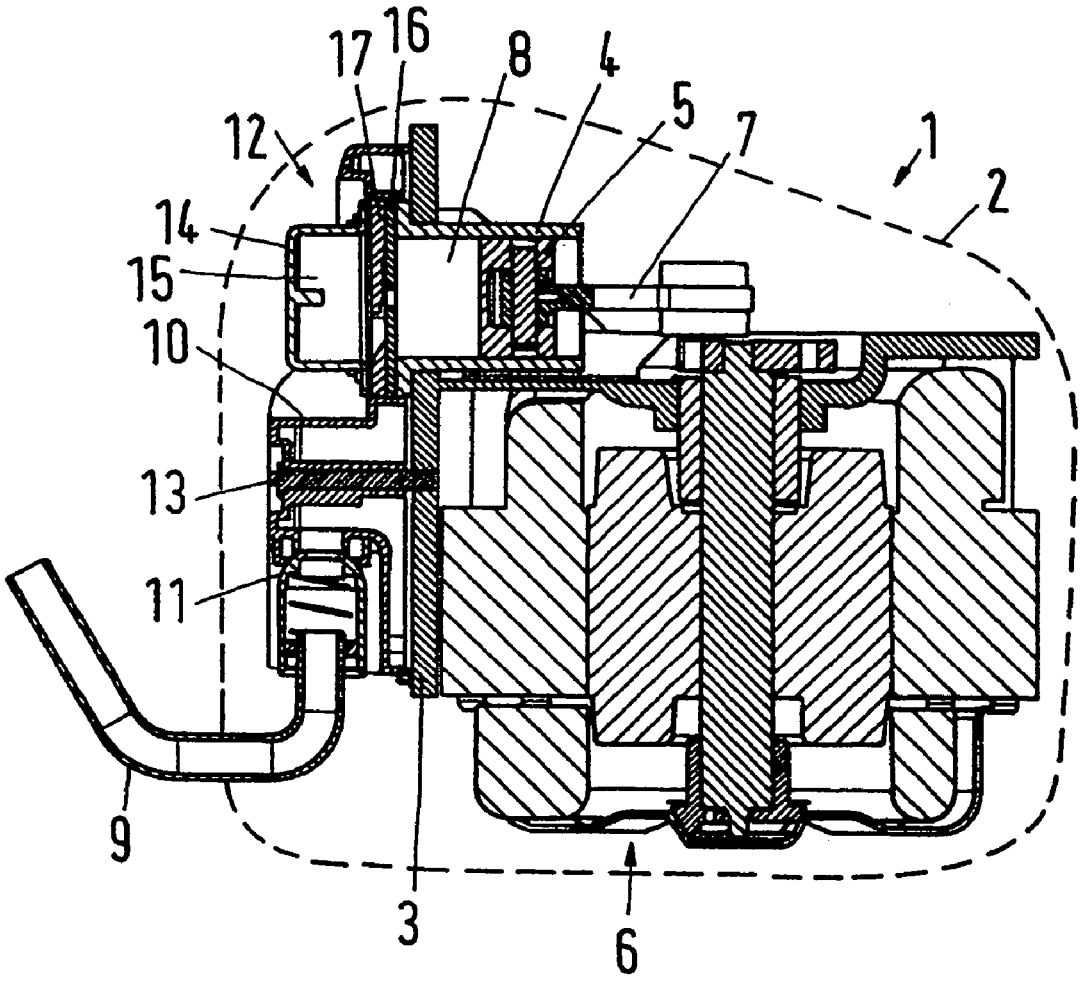
FIG. 1 a schematic vertical section through a refrigerant compressor

FIG. 1 shows a compressor 1 with an enclosed housing 2. In the housing 2 is arranged a compressor block 3 carrying a cylinder 4, in which a piston 5 is arranged to be reciprocating. The movement of the piston 5 is effected by a motor 6, which acts upon the piston 5 via a connecting rod 7.

The reciprocating movement of the piston 5 periodically increases and reduces a volume of a compression chamber 8. A gas in the compression chamber 8 is compressed by a movement of the piston 5 to the left (in relation to FIG. 1).

The gas is sucked in through a suction connection 9, which is connected with a suction muffler 10 via a ball joint 11. The ball joint 11 permits a certain movability between the suction connection 9 and the suction muffler 10, without abandoning the tightness of the connection.

The suction muffler 10 is connected with a cylinder head 12 and fixed on the compressor block 3 by means of a bolt 13. The suction muffler 10 has an inlet opening 38, which is arranged in an inwardly directed cylinder pipe section 39. Arranged next to the inlet opening are baffles 40, which guide the inflowing gas in certain directions. The baffles are arranged on both sides of a pipe section 41, through which the fixing bolt can be guided.

In the present embodiment, the cylinder head 12 is even adopted in the suction muffler 10. The cylinder head has a cylinder head cover 14 of a metal or another material with high heat conductivity. The cylinder head cover 14 surrounds a discharge chamber 15, which is separated from the compression chamber 8 by a valve plate 16 and a retainer element 17.

The valve plate 16 and the retainer element 17, which will be described below, are made of a material, whose heat conductivity is poorer than that of unalloyed steel or sintered steel, which have until now been used to form these parts. Particularly, the valve plate 16 and/or the retainer element 17 can be made of a ceramic material. Also high-grade steel or fibre-reinforced plastic materials are possible. However, ceramic materials are preferred, particularly sintered aluminium oxide or silicon nitride with a heat conductivity coefficient in the range from 15 to 30 W/m/K or zirconium oxide ceramic with a heat conductivity of 2 W/m/K, all at a temperature of about 100° C. In this case, the valve plate 16 and the retainer element 17 can be made by pressing, drying or sintering a granulate mixed with a binder, which makes it possible to manufacture complex structures without expensive refinishing, which meet relatively accurate tolerances. With a heat conductivity coefficient in the range from 15 to 20 W/m/K, also stainless steel is significantly lower than unalloyed steel or sintered steel (about 50 W/m/K), which has been used until now.

Figure 2:
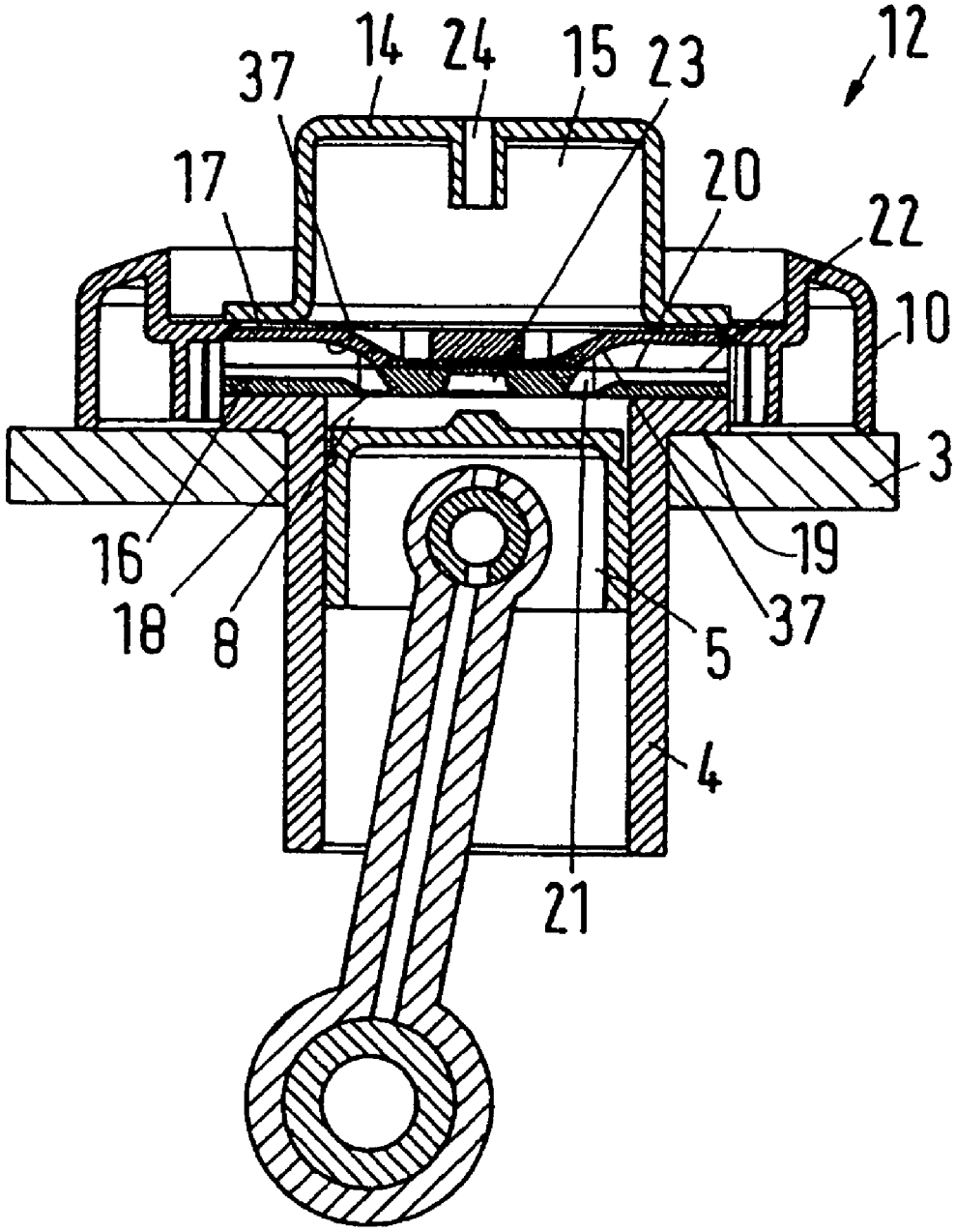
FIG. 2 a horizontal section through cylinder head, piston and connecting rod of a compressor in a schematic view FIG. 3 an exploded, perspective bottom view of cylinder head elements FIG. 4 a top view according to FIG. 3

FIG. 2 shows the mounting of the cylinder head 12 on the compressor block 3 with further details. Same parts have the same reference numbers as in FIG. 1.

The valve plate 16 bears on the cylinder 4 via a suction valve plate 18, the cylinder 4 having for this purpose a circumferential projection 19, to increase the bearing surface of the suction valve plate 18. A discharge valve plate 20 is arranged on the valve plate 16. The discharge valve plate 20 is arranged between the valve plate 16 and the retainer element 17.

The valve plate 16 has several, in the present case two, suction gas openings 21, each being connected with a suction gas channel 22, which extends in the radial direction compared with the movement direction of the piston 5. Thus, in a manner of speaking, the suction gas is sucked laterally from the suction muffler 10.

Further, the valve plate 16 has a discharge gas opening 23, through which gas under a higher pressure, after the compression, can flow axially into the discharge gas chamber 15. From the discharge gas chamber 15, the gas can then be discharged through an outlet opening 24.

Figure 3:
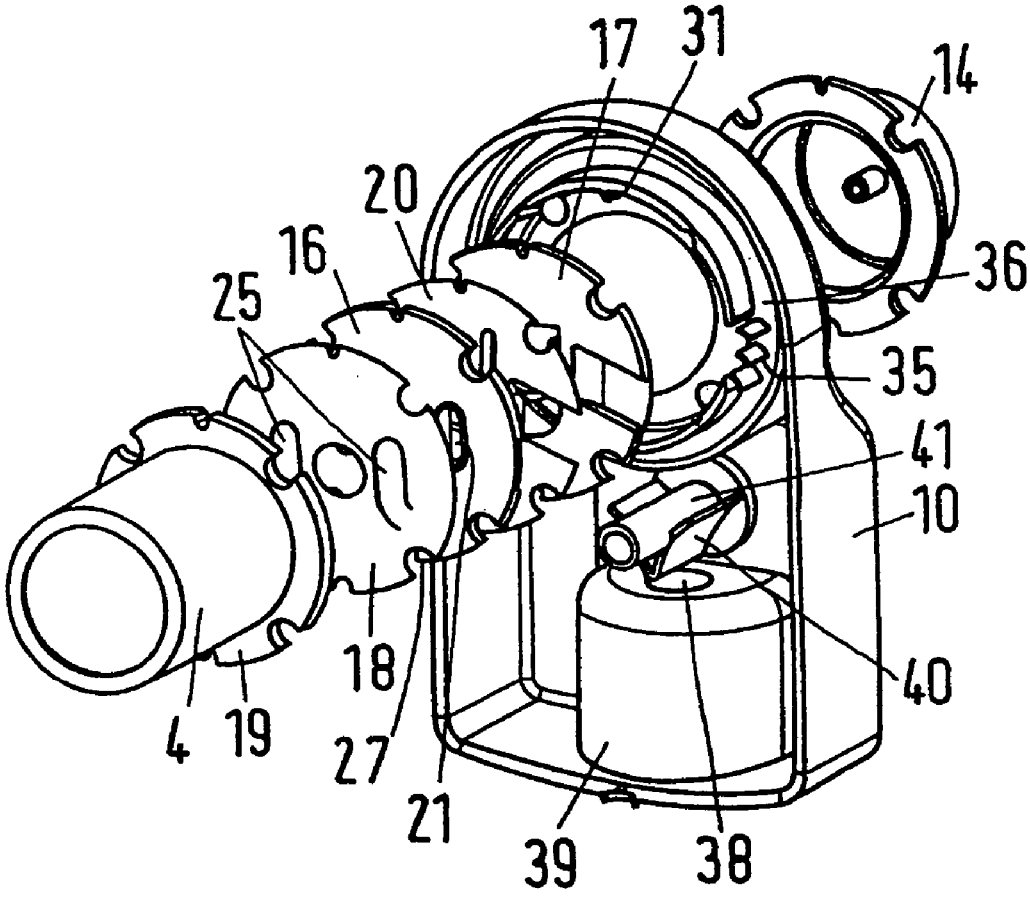
Figure 4:
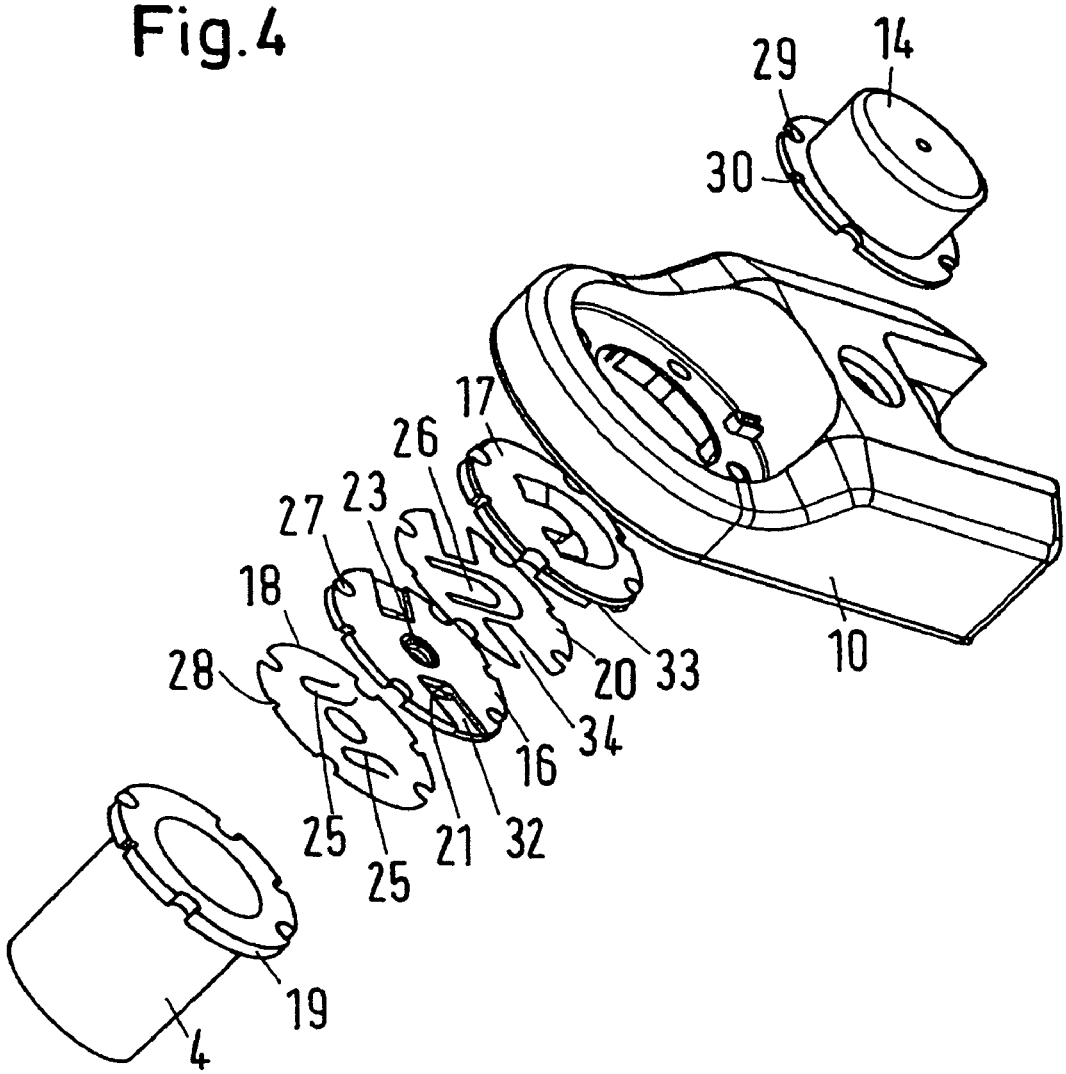

The FIGS. 3 and 4 show perspective views of the cylinder head. Same parts have the same reference numbers as in FIGS. 1 and 2.

From FIGS. 3 and 4 it can be seen that the suction valve plate 18 has two valve leaves 25, which cover the suction gas openings 21 in the valve plate 16. During a suction process, that is, when the piston 5 moves away from the suction valve plate 18, the valve leaves 25 open and release a flow path for the suction gas through the suction gas openings 21. When the piston moves in the opposite direction, the valve leaves 25 rest on the valve plate 16 and close the suction gas openings 21.

In a similar manner, the discharge valve plate 20 has a valve leaf 26, which covers the discharge gas opening 23. During a suction process of the piston 5, the valve leaf 26 is sucked to rest on the valve plate 16. During a discharge movement, the valve leaf 26 is lifted off the valve plate 16 and releases the discharge gas opening 23. The retainer element 17 limits a movement of the valve leaf 26 in the direction of the discharge chamber 15.

Different from the present embodiment, of course also more than one discharge gas opening can be provided, in which case all discharge gas openings should possibly be provided with their own valve leaves.

All parts described, that is, the projection 19, the suction valve plate 18, the valve plate 16, the discharge valve plate 20 and the retainer element 17 have circular cross-sections. Thus, it is possible, in a simple manner, to surface-grind these parts through rotation, so that when mounting, additional sealings can be avoided. The valve plate 16 and the retainer element 17, as well as the projection 19 of the cylinder 4, which can also be called a flange, have such high natural rigidities and can be made with such high surface qualities that they bear tightly on each other.

On their circumferences, the projection 19, the suction valve plate 18, the valve plate 16, the discharge valve plate 20 and the retainer element 17 have large recesses 27, serving to adopt fixing bolts, not shown in detail, and small recesses 28 serving as alignment assistance. Corresponding recesses 29, 30 can be provided on the cylinder head cover 14. Thus, it is possible to insert the parts 19, 18, 16, 20, 17 in the suction muffler 10 and align them in relation to the projections 31. Then, the inserted stack can be fixed in the axial direction by means of bolts (not shown in detail). For this purpose, the bolts can be screwed into the compressor block 3.

As mentioned above, the suction channels 22 are arranged radially, namely between the valve plate 16 and the retainer element 17. To form the suction gas channels 22, the valve plate 16 has radially extending recesses 32 and the retainer element 17 also has radially extending recesses 33. The discharge valve plate 20 has punches 34, so that also when stacking the parts 16, 20, 17 sufficient space remains for the suction gas to flow to the suction gas openings 21.

At the inlet of the suction gas channels 22, the suction muffler 10 has baffles 35, which directs the suction gas from an annular chamber 36 in the suction muffler 10, in which the gas flows substantially in the circumferential direction, radially inward.

As appears particularly from FIG. 2, the suction gas channels 22 have baffles 37, by means of which the suction gas is deflected from the substantially radially oriented flow direction into the axial direction. The baffles 37 have a relatively large curvature radius, so that flow resistances in the suction channels 22 are kept as small as possible. Further, all edges of the suction openings 21 in the valve plate 16 are rounded out; so that also here eddies hardly occur.

The radial arrangement of the suction channels 22 in the cylinder head 12 ensures that the total volume of the cylinder head cover 14 is available for the adoption of the compressed gas, particularly the compressed refrigerant. This improved utilisation of the discharge chamber 15 makes it possible to keep the cross-sectional dimensions of valve plate 16 and retainer element 17 small. This is an advantage with regard to costs. The usual distribution of the volume into suction and discharge chambers with the corresponding sealing problems is no longer necessary.

By means of the retainer element 17, areas containing hot gases are thermally decoupled from areas containing the colder suction gas. Also through the valve plate a thermal coupling is kept small, as both the valve plate 16 and the retainer element 17 have very poor heat conductivity. This heat conductivity is lower than 30 W/m/K.

The fact that suction channels no longer have to be led axially through the retainer element 17 causes that the retainer element can provide a relatively large-volume outlet path for the discharge gas. This gives favourable flow conditions for the gas flowing out under the valve leaf 26 of the discharge valve of the discharge valve plate 20. It is also possible to provide several discharge gas openings. Both measures can contribute to a further reduction of the noise development by reducing the flow velocity of the gas. Also resonance that may occur in the gas flow, can be avoided because of the increase of the flow cross-section.

In order to increase the flow cross section, the suction gas openings 21 can also be designed to be oblong or kidney-shaped.

What is claimed is:

1. A cylinder head arrangement for a piston compressor, the cylinder head arrangement comprising:

a cylinder head cover having a discharge chamber therein;

a valve plate having a suction and a discharge opening therein; and a retainer element, for limiting the movement of a discharge valve during discharge of compressed gas to the discharge chamber, arranged between the cylinder head cover and the valve plate;

wherein a suction gas channel is defined between the retainer element and the valve plate, and extends from a radial outer edge, relative to a piston reciprocation axis, of the valve plate and/or the retainer element to the suction opening such that gas enters the suction channel between the retainer element and the valve plate radially, relative to the piston reciprocation axis.

2. The arrangement according to claim 1, wherein the suction gas channel is radially offset, relative to the piston reciprocation axis, from discharge opening.

3. The arrangement according to claim 2, wherein the suction gas channel extends, relative to the piston reciprocation axis, radially inward from the radial outer edge of the valve plate and/or the retainer element before transitioning toward an axial direction, and has, in the area of the transition from the radial to the axial direction, a curved baffle.

4. An arrangement according to claim 1, wherein the suction opening, has rounded edges.

5. The arrangement according to claim 1, wherein the suction gas channel is formed by a recess in the retainer element and/or in the valve plate.

6. The arrangement according to claim 1, wherein a plurality of suction gas channels are defined between the valve plate and the retainer element, each channel ending in a compression chamber via its own suction opening.

7. The arrangement according to claim 6, wherein the suction openings are arranged around the discharge gas opening.

8. The arrangement according to claim 1, wherein the retainer element and/or the valve plate are made of a material, which has lower heat conductivity than unalloyed steel.

9. The arrangement according to claim 1, wherein the valve plate and/or the retainer element are made of a ceramic material, high-grade steel or fibre-reinforced plastic.

10. The arrangement according to claim 1, wherein the valve plate and/or the retainer element have a surface quality and rigidity, which make additional sealings between the valve plate and the retainer element dispensable.

11. The arrangement according to claim 1, wherein the valve plate and the retainer element are made as substantially circular discs.

12. The arrangement according to claim 1, wherein the suction valve and/or the discharge valve are made as leaf valves with a valve leaf, which is part of a suction or discharge valve plate.

* * * * *